US010278471B2

(12) United States Patent
Shelton et al.

(10) Patent No.: US 10,278,471 B2
(45) Date of Patent: May 7, 2019

(54) HAND HELD APPLIANCE

(71) Applicant: Dyson Technology Limited, Wiltshire (GB)

(72) Inventors: Edward Sebert Maurice Shelton, Swindon (GB); Samuel William Saunders, Swindon (GB); Patrick Joseph William Moloney, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 744 days.

(21) Appl. No.: 14/495,436

(22) Filed: Sep. 24, 2014

(65) Prior Publication Data

US 2015/0093099 A1 Apr. 2, 2015

(30) Foreign Application Priority Data

Sep. 27, 2013 (GB) ..... 1317171.5

(51) Int. Cl.
*A45D 20/12* (2006.01)
*A47J 27/00* (2006.01)

(52) U.S. Cl.
CPC ..... *A45D 20/122* (2013.01); *A45D 20/12* (2013.01)

(58) Field of Classification Search
None
See application file for complete search history.

(56) References Cited

U.S. PATENT DOCUMENTS 2,088,189 A 7/1937 Ducart
4,232,454 A 11/1980 Springer
4,323,761 A 4/1982 Hubner
4,350,872 A 9/1982 Meywald et al.
4,409,998 A 10/1983 Bauer
4,596,921 A 6/1986 Hersh et al.
(Continued)

FOREIGN PATENT DOCUMENTS

CH 588 835 6/1977
CN 200973446 11/2007
(Continued)

OTHER PUBLICATIONS

Search Report dated Mar. 7, 2014, directed to GB Application No. 1317171.5; 1 page.
(Continued)

*Primary Examiner* — Thor S Campbell
(74) *Attorney, Agent, or Firm* — Morrison & Foerster LLP

(57) ABSTRACT

A hand held appliance comprises a body having an outer wall, a duct extending at least partially along the body within the outer wall, an interior passage extending about the duct for receiving a primary fluid flow, a primary fluid outlet for emitting the primary fluid flow from the body, wherein the primary fluid outlet is defined by the duct and an inner wall of the body. The inner wall may extend from the outer wall towards the duct and may extend radially around the duct. The inner wall may extend from the outer wall towards the primary fluid outlet. At least one spacer may be provided between the inner wall and the duct. The at least one spacer may be a supporting rib. The duct may be formed from two parts, a first part fixed to the inner wall and a second part connected to the first part.

34 Claims, 11 Drawing Sheets

(56) References Cited

U.S. PATENT DOCUMENTS

| | | | | |
|---|---|---|---|---|
| 4,635,382 | A | 1/1987 | Bourdeau | |
| 4,767,914 | A | 8/1988 | Glucksman | |
| 4,800,654 | A | 1/1989 | Levin et al. | |
| 5,133,043 | A | 7/1992 | Baugh | |
| 5,155,925 | A | 10/1992 | Choi | |
| D350,413 | S | 9/1994 | Feil | |
| D352,365 | S | 11/1994 | Hansen et al. | |
| 5,378,882 | A | 1/1995 | Gong et al. | |
| 5,444,215 | A | 8/1995 | Bauer | |
| 5,546,674 | A | 8/1996 | Lange et al. | |
| 5,572,800 | A | 11/1996 | West | |
| 5,598,640 | A | 2/1997 | Schepisi | |
| 5,681,630 | A | 10/1997 | Smick et al. | |
| 5,857,262 | A | 1/1999 | Bonnema et al. | |
| 5,875,562 | A | 3/1999 | Fogarty | |
| 5,894,849 | A | 4/1999 | Ehlhardt et al. | |
| 5,956,863 | A | 9/1999 | Allen | |
| 5,996,243 | A | 12/1999 | Chang et al. | |
| 6,148,537 | A | 11/2000 | Altamore | |
| 6,203,349 | B1 | 3/2001 | Nakazawa | |
| 6,285,828 | B1 * | 9/2001 | Cafaro | A45D 20/12 34/266 |
| 6,591,516 | B2 | 7/2003 | Kamada et al. | |
| 6,751,886 | B2 | 6/2004 | Chang et al. | |
| 6,885,810 | B2 * | 4/2005 | Allwohn | A45D 20/12 34/97 |
| 6,889,445 | B1 | 5/2005 | Varona et al. | |
| D550,813 | S | 9/2007 | Lammel et al. | |
| 7,412,781 | B2 | 8/2008 | Mattinger et al. | |
| 7,913,416 | B1 | 3/2011 | Scieri | |
| D646,354 | S | 10/2011 | Gessi | |
| 8,132,571 | B1 | 3/2012 | Jackson | |
| D682,472 | S | 5/2013 | Dyson et al. | |
| D696,386 | S | 12/2013 | Schoenherr et al. | |
| D702,322 | S | 4/2014 | Sieger | |
| 8,734,094 | B2 | 5/2014 | Wallace et al. | |
| 8,782,920 | B2 | 7/2014 | Marthinsen et al. | |
| D716,492 | S | 10/2014 | Dyson et al. | |
| 9,420,864 | B2 * | 8/2016 | Gammack | A45D 20/08 |
| 9,420,865 | B2 * | 8/2016 | Gammack | A45D 20/08 |
| 9,534,610 | B2 | 1/2017 | Stewart et al. | |
| 9,596,916 | B2 * | 3/2017 | Moloney | A45D 20/10 |
| 2004/0083620 | A1 | 5/2004 | McCambridge et al. | |
| 2004/0163274 | A1 | 8/2004 | Andrew et al. | |
| 2004/0172847 | A1 | 9/2004 | Saida et al. | |
| 2005/0229422 | A1 | 10/2005 | Mattinger et al. | |
| 2006/0075654 | A1 | 4/2006 | Lin | |
| 2007/0294909 | A1 | 12/2007 | Abdi et al. | |
| 2009/0052877 | A1 | 2/2009 | Cheng | |
| 2010/0064542 | A1 | 3/2010 | Mulvaney et al. | |
| 2010/0065545 | A1 | 3/2010 | Chung et al. | |
| 2011/0079239 | A1 | 4/2011 | Hall | |
| 2011/0177711 | A1 | 7/2011 | Park | |
| 2011/0203128 | A1 | 8/2011 | Rodrigues | |
| 2011/0219636 | A1 | 9/2011 | Rowling | |
| 2013/0111777 | A1 | 5/2013 | Jeong | |
| 2013/0269200 | A1 | 10/2013 | Moloney et al. | |
| 2013/0269201 | A1 | 10/2013 | Courtney et al. | |
| 2013/0276320 | A1 | 10/2013 | Courtney et al. | |
| 2013/0276321 | A1 | 10/2013 | Courtney et al. | |
| 2013/0283630 | A1 | 10/2013 | Courtney et al. | |
| 2013/0283631 | A1 | 10/2013 | Moloney et al. | |
| 2013/0326898 | A1 | 12/2013 | Quessard et al. | |
| 2014/0007448 | A1 | 1/2014 | Courtney et al. | |
| 2014/0007449 | A1 | 1/2014 | Courtney et al. | |
| 2014/0007450 | A1 | 1/2014 | Yao | |

FOREIGN PATENT DOCUMENTS

| | | |
|---|---|---|
| CN | 100353882 | 12/2007 |
| CN | 101147634 | 3/2008 |
| CN | 201131425 | 10/2008 |
| CN | 201328477 | 10/2009 |
| CN | 201341553 | 11/2009 |
| CN | 101292806 | 10/2010 |
| CN | 201774080 | 3/2011 |
| CN | 201948229 | 8/2011 |
| CN | 202146022 | 2/2012 |
| CN | 202536440 | 11/2012 |
| CN | 202774786 | 3/2013 |
| DE | 26 18 819 | 11/1977 |
| DE | 195 27 111 | 1/1997 |
| DE | 10 2009 049 838 | 4/2011 |
| EP | 0 105 810 | 4/1984 |
| EP | 0 300 281 | 1/1989 |
| EP | 0 306 765 | 3/1989 |
| EP | 0 400 381 | 12/1990 |
| EP | 0 970 633 | 1/2000 |
| EP | 1 433 401 | 8/2004 |
| EP | 1 616 500 | 1/2006 |
| EP | 1 902 643 | 3/2008 |
| EP | 2 000 042 | 12/2008 |
| EP | 2 255 692 | 12/2010 |
| EP | 2 392 223 | 12/2011 |
| EP | 2 401 939 | 1/2012 |
| FR | 1387334 | 1/1965 |
| FR | 1408096 | 8/1965 |
| GB | 647291 | 12/1950 |
| GB | 953057 | 3/1964 |
| GB | 1 446 385 | 8/1976 |
| GB | 1 456 000 | 11/1976 |
| GB | 1 489 723 | 10/1977 |
| GB | 1 539 485 | 1/1979 |
| GB | 2 295 056 | 5/1996 |
| GB | 2 316 868 | 3/1998 |
| GB | 2472240 | 2/2011 |
| GB | 2478927 | 9/2011 |
| GB | 2482547 | 2/2012 |
| GB | 2482548 | 2/2012 |
| GB | 2482549 | 2/2012 |
| GB | 2500798 | 10/2013 |
| GB | 2500800 | 10/2013 |
| GB | 2503684 | 1/2014 |
| GB | 2503685 | 1/2014 |
| GB | 2503686 | 1/2014 |
| JP | 55-113408 | 9/1980 |
| JP | 58-32706 | 3/1983 |
| JP | 60-100902 | 6/1985 |
| JP | 60-135700 | 7/1985 |
| JP | 1-27506 | 1/1989 |
| JP | 1-29208 | 1/1989 |
| JP | 4-221507 | 8/1992 |
| JP | 5-7507 | 1/1993 |
| JP | 5-9404 | 2/1993 |
| JP | 5-130915 | 5/1993 |
| JP | 7-16113 | 1/1995 |
| JP | 3014299 | 8/1995 |
| JP | 2000-506769 | 6/2000 |
| JP | 2000-201723 | 7/2000 |
| JP | 2001-37530 | 2/2001 |
| JP | 2002-238649 | 8/2002 |
| JP | 2003-153731 | 5/2003 |
| JP | 2004-312 | 1/2004 |
| JP | 2004-113402 | 4/2004 |
| JP | 2004-208935 | 7/2004 |
| JP | 2004-283549 | 10/2004 |
| JP | 2004-293389 | 10/2004 |
| JP | 2004-357763 | 12/2004 |
| JP | 2005-546 | 1/2005 |
| JP | 2006-51181 | 2/2006 |
| JP | 2006-130181 | 5/2006 |
| JP | 2006-181265 | 7/2006 |
| JP | 2007-136121 | 6/2007 |
| JP | 2010-274050 | 12/2010 |
| JP | 2012-45178 | 3/2012 |
| WO | WO-83/02753 | 8/1983 |
| WO | WO-94/23611 | 10/1994 |
| WO | WO-2004/006712 | 1/2004 |
| WO | WO-2005/120283 | 12/2005 |
| WO | WO-2007/043732 | 4/2007 |
| WO | WO-2008/053099 | 5/2008 |
| WO | 2011/131965 | 10/2011 |

(56) References Cited

FOREIGN PATENT DOCUMENTS

| | | |
|---|---|---|
| WO | WO-2012/059700 | 5/2012 |
| WO | WO-2012/069983 | 5/2012 |
| WO | WO-2012/076885 | 6/2012 |

OTHER PUBLICATIONS

Courtney et al., Office Action dated Sep. 24, 2014, directed to U.S. Appl. No. 13/853,739; 12 pages.

Reba, I. (1966). "Applications of the Coanda Effect," Scientific American 214:84-92.

International Search Report and Written Opinion dated Dec. 8, 2014, directed to International Application No. PCT/GB2014/052849; 12 pages.

* cited by examiner

HAND HELD APPLIANCE

REFERENCE TO RELATED APPLICATIONS

This application claims the priority of United Kingdom Application No. 1317171.5, filed Sep. 27, 2013, the entire contents of which are incorporated herein by reference.

FIELD OF THE INVENTION

This invention relates to a hand held appliance, in particular a hair care appliance and a fluid outlet from such an appliance.

BACKGROUND OF THE INVENTION

Blowers and in particular hot air blowers are used for a variety of applications such as drying substances such as paint or hair and cleaning or stripping surface layers. In addition, hot air blowers such as hot styling brushes are used to style hair from a wet or dry condition.

Generally, a motor and fan are provided which draw fluid into a body; the fluid may be heated prior to exiting the body. The motor is susceptible to damage from foreign objects such as dirt or hair so conventionally a filter is provided at the fluid intake end of the blower. Conventionally such appliances are provided with a nozzle which can be attached and detached from the appliance and changes the shape and velocity of fluid flow that exits the appliance. Such nozzles can be used to focus the outflow of the appliance or to diffuse the outflow depending on the requirements of the user at that time.

SUMMARY OF THE INVENTION

According to a first aspect, the invention provides a hand held appliance comprising a body having an outer wall, a duct extending at least partially along the body within the outer wall, an interior passage extending about the duct for receiving a primary fluid flow, a primary fluid outlet for emitting the primary fluid flow from the body, wherein the primary fluid outlet is defined by the duct and an inner wall of the body.

Thus, fluid flowing through the interior passage is directed towards the primary fluid outlet using internal walls of the appliance. This means that the appearance of the outer wall is unaffected by a change in shape and size of the interior passage so the external features of the appliance can be clean and simple and the internal workings of the appliance are kept hidden from the user.

Preferably, the inner wall extends from the outer wall towards the duct. The inner wall thus converges fluid flow towards the duct.

It is preferred that the inner wall extends radially around the duct.

Preferably, the inner wall extends from the outer wall towards the fluid outlet.

It is preferred that at least one spacer is provided between the inner wall and the duct. The spacer provides a support between the inner wall and the duct and maintains the relative locations of the inner wall with respect to the duct.

Preferably, the at least one spacer comprises a plurality of spacers radially spaced from each other. It is preferred that at least one spacer is a supporting rib.

Preferably, the duct is formed from two parts, a first part which is fixed to the inner wall and a second part which connects to the first part. It is preferred that the first part of the duct is fixed to the inner wall by at least one supporting rib. Preferably, the first part of the duct, the inner wall and the at least one supporting rib are moulded as a single unit. This single unit is an air exit for the appliance and moulding it as a single unit means that tolerances between each feature of the air exit is fixed both for a single air exit and for multiple copies of an air exit. Thus, reliability of the appliance is improved.

Also disclosed is a hair care appliance comprising a body having an outer wall, a duct extending at least partially along the body within the outer wall, an interior passage extending about the duct for receiving a primary fluid flow, a primary fluid outlet for emitting the primary fluid flow from the body, wherein the primary fluid outlet is defined by the duct and an inner wall of the body, wherein the duct is formed from two parts, a first part which is fixed to the inner wall and a second part which connects to the first part.

It is preferred that the first part of the duct connects to the second part of the duct in one orientation. This is useful for construction of the appliance particularly when the first part of the duct, supporting ribs and the inner wall are moulded as a single unit (the air exit) as the duct and therefore the inner wall have one single fixed orientation.

Preferably, the connection between the first part of the duct and the second part of the duct includes a lap joint. It is preferred that one of the first and second parts of the duct includes a recess and the other one of the first and second parts includes a projection adapted to cooperate with the at least two recesses to provide the connection.

It is preferred that three recesses and protrusions are provided. Preferably, the three recesses and protrusions are unequally angularly spaced. Alternatively or additionally, recesses and projections are of different configuration. The different configuration includes different size and/or shape of the recesses and projection pairs. This again ensures that there is only one way to connect the respective parts of the connection.

It is preferred that the inner wall comprises a sealing portion and a flow directing portion. The sealing portion prevents leakage of primary flow and the flow directing portion directs the primary fluid flow towards the primary fluid outlet.

Preferably, the sealing portion seals between the outer wall and the inner wall.

It is preferred that the sealing portion is a flexible gasket that extends about the inner wall.

It is preferred that the sealing portion is spaced from an end of the inner wall. Preferably, a region defined between the inner wall, sealing portion and the outer wall is a cooling path.

It is preferred that the flow directing portion comprises a surface of the inner wall that together with the duct defines a part of the interior passage. Preferably, the surface of the inner wall is smooth. This minimises turbulence created as the primary flow is directed towards the primary fluid outlet as the interior passage reduces in cross section.

In a preferred embodiment, the appliance comprises a heater extending about the duct. Preferably, the heater is annular. This provides more even heating of the primary fluid flowing through the primary fluid flow path.

It is preferred that wherein the heater is housed within a sleeve. Preferably, the sleeve extends longitudinally beyond the heater at one end. It is preferred that the sleeve extension is adapted to cooperate with the inner wall to locate the heater longitudinally within the body. Preferably, the sleeve extension is adapted to cooperate with the inner wall to locate the heater radially within the body. This locates the position of the heater with respect to the inner wall and the duct.

It is preferred that the inner wall includes a ledge and the ledge supports the sleeve extension. Preferably, the one of the inner wall and the sleeve extension includes a recess and the other one of the inner wall and sleeve extension includes a projection adapted to cooperate with the recess. Preferably, three recesses and protrusions are provided. It is preferred that the three recesses and protrusions are unequally angularly spaced. Alternatively or additionally, the recesses and the projections are of different configuration.

Thus, it is preferred that the heater can only connect in one orientation to the inner wall and when this feature is used in combination with other preferred features of the invention the result is that there is only one way to assembly the different components that are housed within the body of the appliance. As the heater, for example requires connection to a power source, this means that those connectors will always be radially located with the body in the same place making assemble quicker, more efficient and cost effective.

Preferably, the fluid outlet is at a downstream end of the body. It is preferred that the inner wall has a downstream end and an upstream end and the downstream end at least partially defines the fluid outlet.

Preferably, the upstream end of the inner wall extends towards the outer wall. Preferably, the inner wall includes a sealing portion that extends to the outer wall. It is preferred that the sealing portion is between the upstream end and downstream end of the inner wall.

Preferably, the upstream end of the inner wall includes a connector for connecting with a heater. It is preferred that the connector extends radially around the inner wall. Preferably, the connector includes a stop extending radially out from the inner wall. It is preferred that the stop extends radially out towards the outer wall.

Preferably, the heater includes a housing which extends radially about the heater. It is preferred that the housing extends longitudinally away from the heater at a downstream end of the heater. Preferably, the extension of the heater housing is adapted to engage with the connector and the stop to locate the heater with respect to the inner wall, duct and outer wall of the appliance.

It is preferred that the inner wall includes a flow directing portion for directing flow from the heater towards the fluid outlet.

Preferably, the interior passage reduces in diameter along the inner wall from the upstream end of the inner wall to the fluid outlet at the downstream end of the inner wall.

It is preferred that the flow directing portion is a smooth curved surface of the inner wall.

According to a second aspect of the invention is a hair care appliance comprising a body having an outer wall, a duct extending at least partially along the body within the outer wall, an interior passage extending about the duct for receiving a primary fluid flow, a primary fluid outlet for emitting the primary fluid flow from the body, wherein the primary fluid outlet is defined by the duct and an inner wall of the body.

Preferably, the primary fluid outlet is in a front end of the body and the front end of the body comprises an end wall extending radially inwards of the body and the end wall comprises at least one magnet. It is preferred that the end wall abuts a plurality of magnets or a ring of magnetic material. The plurality of magnets or ring of magnetic material preferably extends around the end wall. Preferably, the end wall comprises an outer face and an inner face, the outer face being an external surface of the appliance, wherein the plurality of magnets are adjacent the inner face. The plurality of magnets is preferably received in an inner wall of the body. Preferably the inner wall forms part of an air exit as previously described herein. Preferably, the inner wall includes an inner facing surface which is a flow directing surface which together with the duct defines part of the interior passage. In addition the inner wall preferably includes a plurality of receiving units disposed around an outer facing surface for receiving the plurality of magnets.

BRIEF DESCRIPTION OF THE DRAWINGS

The invention will now be described by example, with reference to the accompanying drawings, of which.

DETAILED DESCRIPTION OF THE INVENTION

Figure 2:
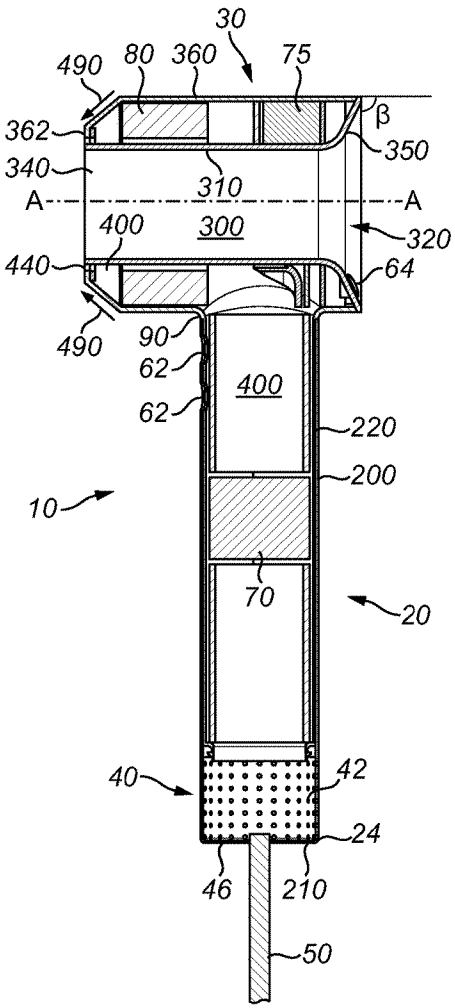
FIG. 2 shows a cross section through the appliance of FIG. 1.
Figure 1:
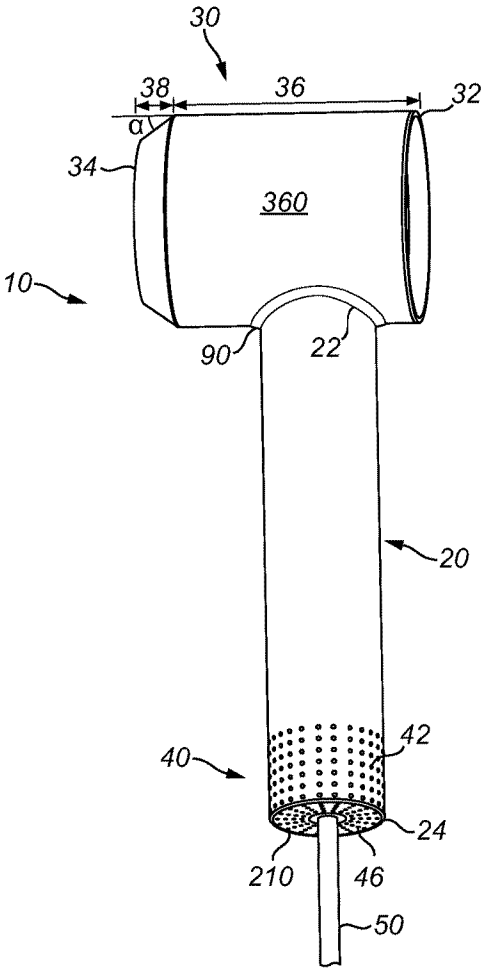
FIG. 1 shows a perspective view of an appliance according to the invention.

FIGS. 1 and 2 show an example of a hairdryer 10 which is suitable for use with the invention. The hairdryer 10 has a handle 20 and a body 30. The handle has a first end 22 which is connected to the body 30 and a second end 24 distal from the body 30 and which includes a primary inlet 40. Power is supplied to the hairdryer 10 via a cable 50.

The body 30 has a first end 32 and a second end 34 and can be considered to have two parts. A first part 36 which extends from the first end 32 which is generally tubular and a second part 38 which extends from the second end 34 to join the first part 36. The second part 38 is cone shaped and varies in diameter along its length from the diameter of the first part 36 of the body 30 to a smaller diameter at the second end 34 of the body. In this example, the second part 38 has a constant gradient and the angle α subtended from the outer wall 360 of the first part 36 of the body 30 is around 40°.

Referring now to FIG. 2 in particular the handle 20 has an outer wall 200 which extends from the body 30 to a distal end 24 of the handle. At the distal end 24 of the handle an end wall 210 extends across the outer wall 200. The cable 50 enters the hairdryer through this end wall 210. The primary inlet 40 in the handle 20 includes first apertures that extend around and along 42 the outer wall 200 of the handle and second apertures that extend across 46 and through the end wall 210 of the handle 20. The cable 50 is located approximately in the middle of the end wall 210 so extends from the centre of the handle 20. The end wall 210 is orthogonal to the outer wall 200 and inner wall 220 of the handle.

It is preferred that the cable 50 extends centrally from the handle 20 as this means the hairdryer is balanced regardless of the orientation of the handle 20 in a users' hand. Also, if the user moves the position of their hand on the handle 20 there will be no tugging from the cable 50 as it does not change position with respect to the hand when the hand is moved. If the cable were offset and nearer one side of the handle then the weight distribution of the hairdryer would change with orientation which is distracting for the user.

Upstream of the primary inlet 40, a fan unit 70 is provided. The fan unit 70 includes a fan and a motor. The fan unit 70 draws fluid through the primary inlet 40 towards the body 30 through a primary fluid flow path 400 that extends from the primary inlet 40 and into the body 30 where the handle 20 and the body 30 are joined 90. The primary fluid flow path 400 continues through the body 30 towards the second end 34 of the body, around a heater 80 and to a primary fluid outlet 440 where fluid that is drawn in by the fan unit exits the primary fluid flow path 400. The primary fluid flow path 400 is non-linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the duct 310 towards the primary fluid outlet 440 at the second end of the body 34.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the duct 310 which is an inner wall of the body 30 and extends within and along the body. A fluid flow path 300 extends within the duct from the fluid inlet 320 to the fluid outlet 340. At the first end 32 of the body 30, a side wall 350 extends between the outer wall 360 and the duct 310. This side wall 350 at least partially defines the fluid inlet 320. At the second end 34 of the body a gap is provided between the outer wall 360 and the duct, this gap defines the primary fluid outlet 440. The primary fluid outlet 440 is annular and surrounds the fluid flow path 300. The primary fluid outlet 440 may be internal so the primary fluid flow path 400 merges with the fluid flow path 300 within the body 30. Alternatively, the primary fluid outlet 440 is external and exits from the body 30 separately to the fluid from the fluid flow path 300 at the fluid outlet 340.

The outer wall 360 of the body converges towards the duct 310 and a centre line A-A of the body 30. Having an outer wall 360 that converges towards the duct 310 has the advantage that the primary flow exiting the primary fluid outlet 440 is directed towards the centre line A-A of the body 30. The fluid exiting the primary fluid outlet 440 will cause some external entrainment of fluid 490 from outside the hairdryer due to the movement of the fluid from the primary outlet 440. This effect is increased by the outer wall 360 converging towards the duct 310. Partly this is because the primary flow is focused rather than divergent and partly this is because of the slope of the outer wall 360 of the body 30 towards the second end 34 of the hairdryer.

The duct 310 is an internal wall of the hairdryer that can be accessed from outside the hairdryer. Thus, the duct 310 is an external wall of the hairdryer. The duct 310 is recessed within the body 30 so the side wall 350 that connects between the outer wall 360 and the duct 310 is angled with respect to the outer wall 360. The angle β is around 115° from a line subtended by the outer wall 360 of the body 30 (FIG. 2).

A PCB 75 including the control electronics for the hairdryer is located in the body 30 near the side wall 350 and fluid inlet 320. The PCB 75 is ring shaped and extends round the duct 310 between the duct 310 and the outer wall 360. The PCB 75 is in fluid communication with the primary fluid flow path 400. The PCB 75 extends about the fluid flow path 300 and is isolated from the fluid flow path 300 by the duct 310.

The PCB 75 controls such parameters as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

In use, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Figure 3:
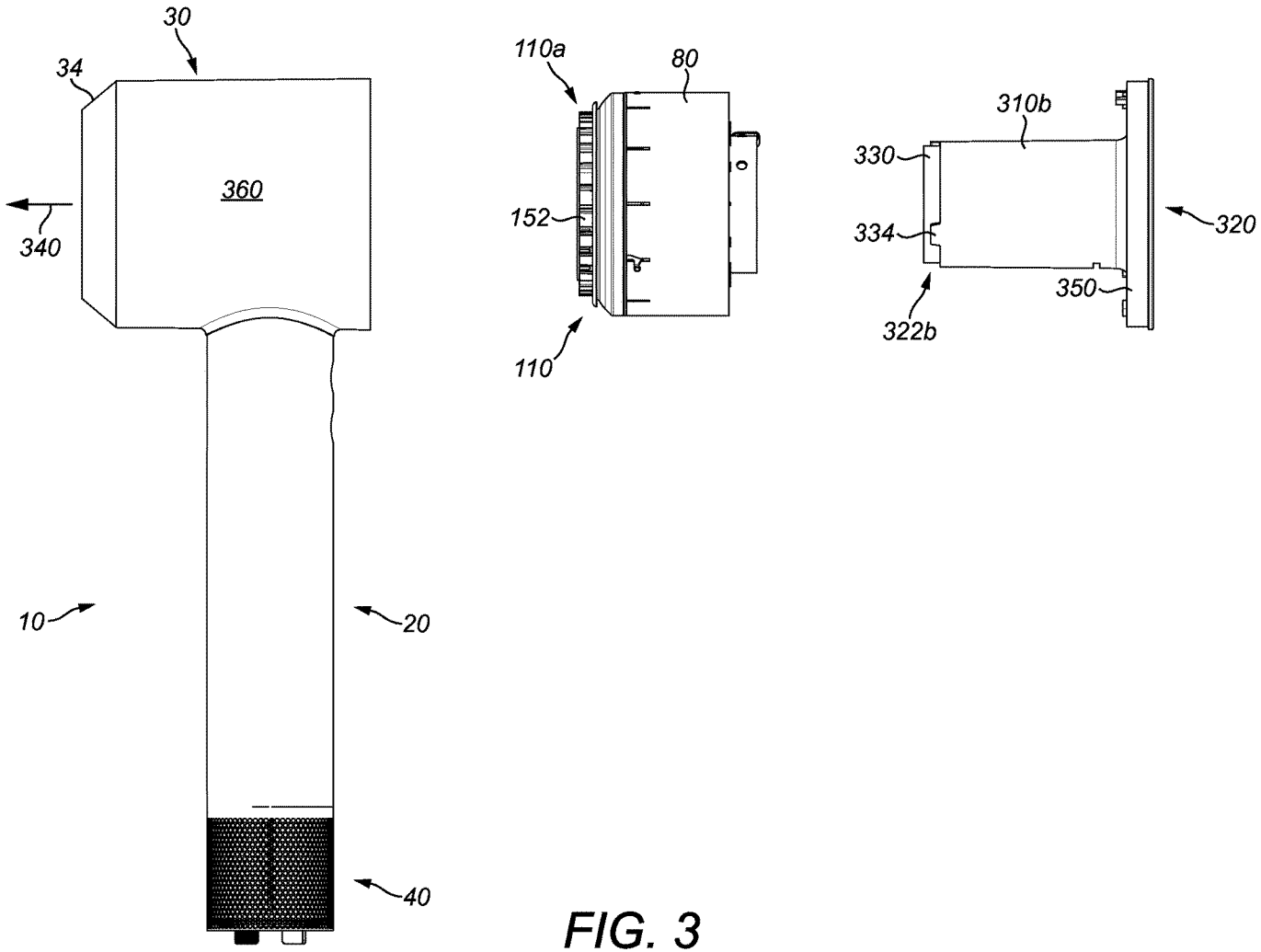
FIG. 3 shows an exploded side view of the appliance of FIGS. 1 and 2.
Figure 4B:
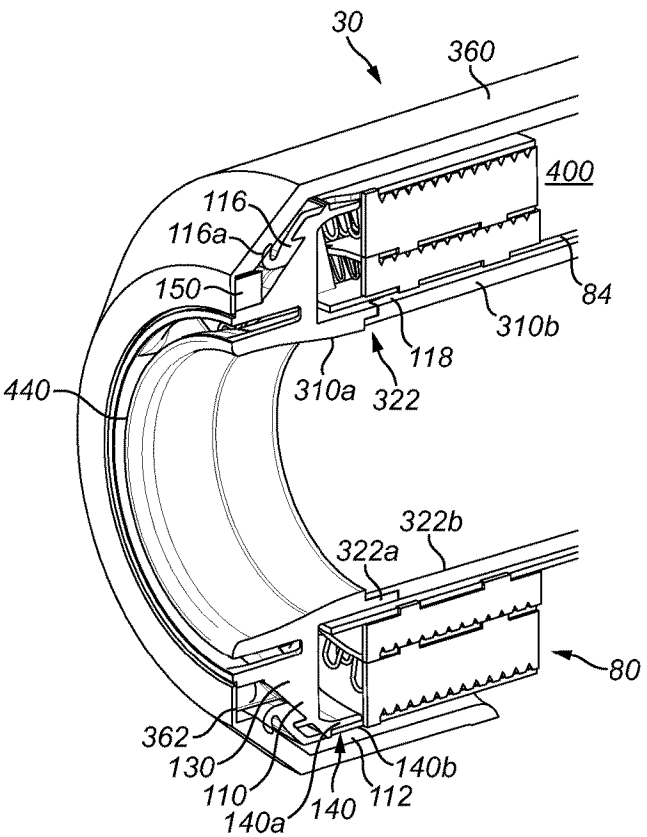
FIG. 4*b* shows an isometric cross section through a part of the body of FIG. 4*a;*
Figure 4A:
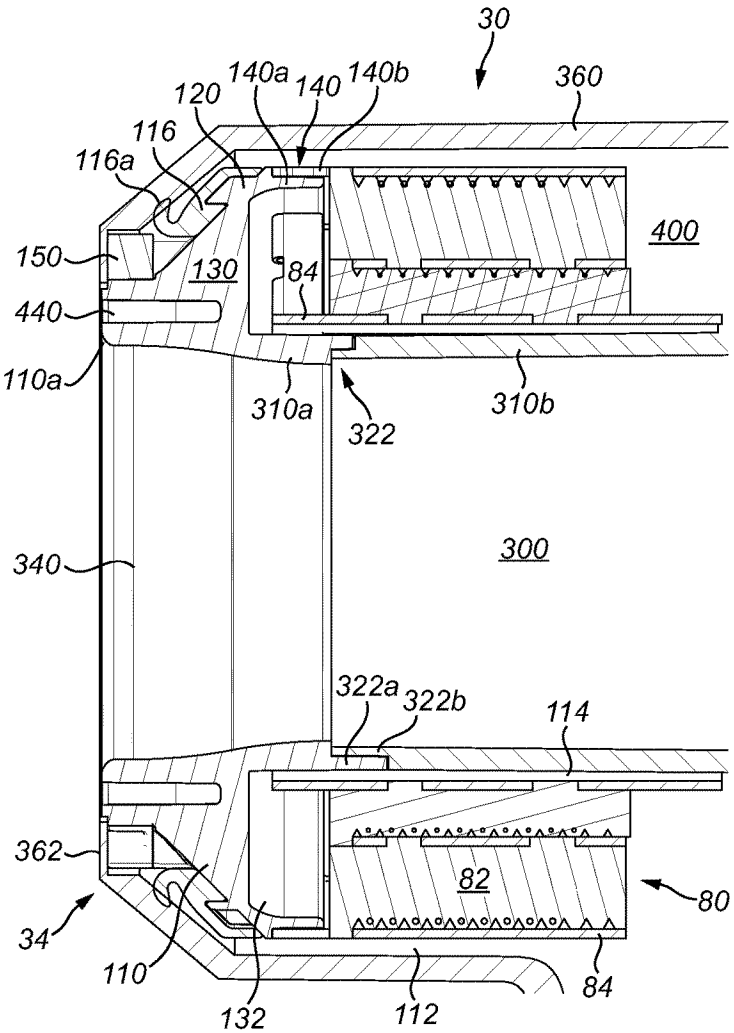
FIG. 4*a* shows a cross section through a body of an appliance according to the invention.

FIG. 3 shows an exploded side view of a hairdryer 100 using an air exit 110 according to the invention. FIGS. 4*a* and 4*b* show a cross section through a hairdryer 100 showing the air exit 110 in situ with the heater 80 and FIGS. 5 to 9 show various views and cross sections through the air exit 110. For features that are common between Figures, the same reference numerals will be used.

The air exit 110 has been designed so that it can provide positive locking of various features within the appliance. In addition, it is preferred that the positive locking can only be achieved in one orientation so for every product manufactured it is guaranteed that connections between different features such as an electrical connection from the heater 80 to the PCB 75 will be in the same place and are repeatable.

Referring in particular to FIGS. 4*a* to 12, the air exit 110 has a first duct 310*a* and an inner wall 120 which are connected together by supporting ribs 130. The inner wall 120 channels fluid flowing in the primary fluid flow path 400 towards the primary fluid outlet 440. The inner wall 120 includes a flow directing portion 132 which channels or directs flow exiting the heater 80 towards the primary fluid outlet 440 as the diameter of the body 30 decreases towards the second end 34 of the body 30. The first duct 310*a* is adapted to connect with a second duct 310*b* to form a whole duct 310 which extends from the side wall 350 to the downstream end 34 of the body 30 where the fluid outlets 340 and 440 are located. The connection 322 is formed from two cooperating parts which form a lap joint between the first duct 310*a* and the second duct 310*b* (FIG. 4).

Referring now to FIGS. 4*a*, 4*b*, 8 and 11 in particular, the air exit 110 includes a first part 322*a* of the connection 322 which has an outer lip 328 of the lap joint having with three spaced apart recesses 324, 326, 328. The second duct 310*b* includes a second part 322*b* of the connection 322 which has an inner lip 330 with three spaced apart projections 332, 334, 336. A first pair of recess and projection 324,336 respectively is smaller than the other two pairs of recess and projection 326,334 and 236,332 respectively so the first duct 310*a* can only be inserted into the second duct 310*b* in one orientation.

Referring in particular to FIGS. 4*a*, 4*b*, 8 and 12, the air exit 110 has a second connection 140 to the heater 80. This second connection 140 is formed from two cooperating parts which form a lap joint between the inner wall 120 and the heater 80. The inner wall 120 includes a first part 140*a* of the second connection 140 which has an inner lip 122 of the lap joint having three spaced apart pips 124, 126, 128 which protruded radially outwardly from the inner lip 122. The heater 80 includes a second part 140*b* of the connection 140. The heater element 82 is surrounded by an outer sleeve 84 which is a ring of insulating material, such as Mica. This outer sleeve 84 extends along the length of the heater element 82 (which is for example, a coiled wire) and extends downstream of the heater element 82 towards the fluid outlets 340, 440 of the body 30. Part of the extension downstream of the heater element 82 forms a second part 140*b* of the second connection 140. The second part 140*b* of the connection 140 includes three holes 88, 92, 94 or recesses in the sleeve 84.

In the embodiment shown the three holes 88, 92, 94 are 'L' shaped so the connection 140 is properly made by a push and twist motion. This is a preferred feature and it provides a more secure connection than simply pushing the pips 124, 126, 128 into each hole 88, 92, 94.

Each pip 124, 126, 128 and holes 88, 92, 94 are the same diameter; however they are not equally angularly spaced around the lap joint. Thus, the heater 80 can only be connected to the air exit 110 by the second connection 140 in one orientation. This means that the heater 80, air exit 110, the duct 310 and the side wall 350 are all connectable together in one predetermined orientation. This is extremely useful. In the hairdryer shown in FIG. 2, the side wall 350 includes control buttons 64 which extend from the PCB and the heater will have wires (not shown) connecting to the PCB. In the arrangement described, that the heater 80 will always be in the same orientation with respect to the PCB making assembly and electrical connection of the heater to the PCB simpler.

It is also advantageous, but not essential that the air exit 110 includes the inner lip of one of the first or second connections and the outer lip of the other connection as this constrains the heater 80, the air exit 110 and the duct 310 radially with respect to each other. The lap joints 322, 140 can be reversed i.e. the inner and outer lips can be formed on the opposite parts of each respect lap joint 322, 140 as can the location of the protrusions and recesses. Indeed each of the first and second connections can use unequal angular spacing and/or a different configuration of protrusions and recesses. The configuration includes the shape or profile and the sizes of each pair of protrusion and recess.

Figure 13:
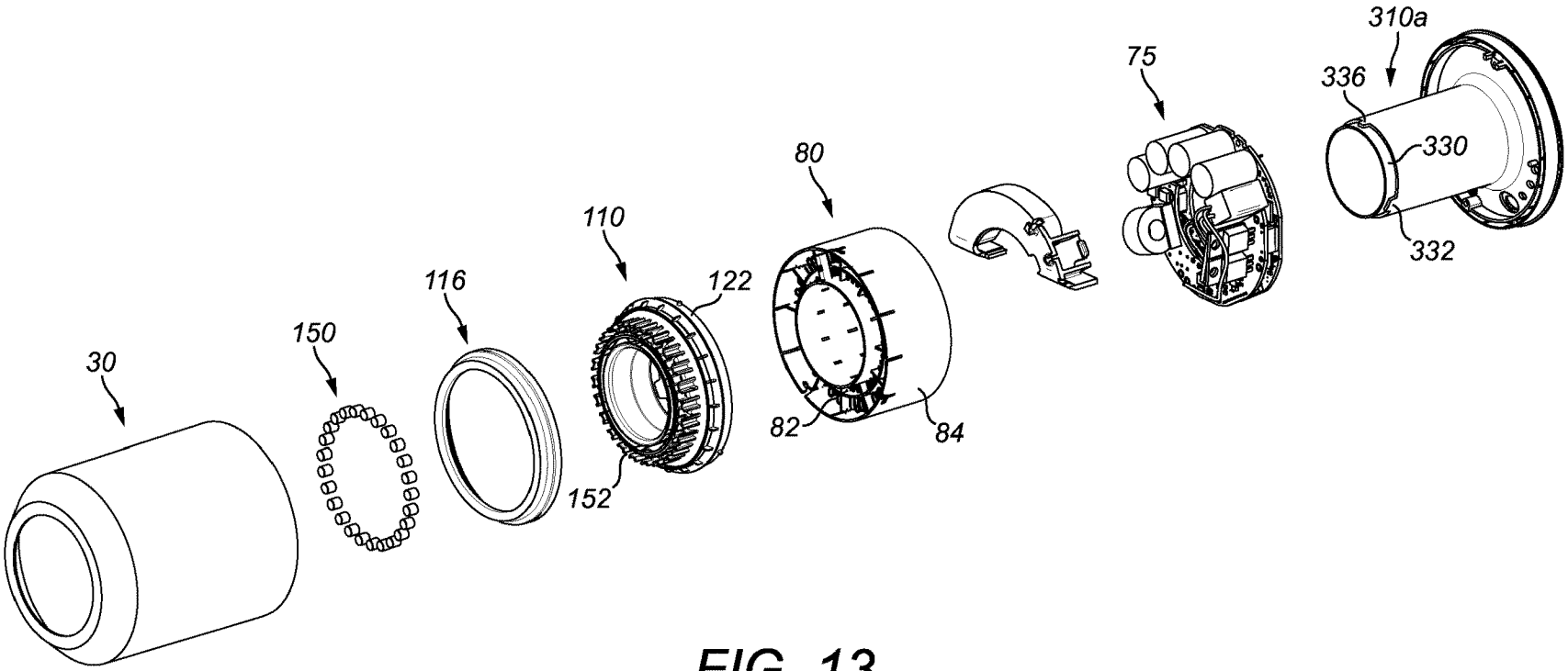
FIG. 13 shows an exploded isometric view through a head of FIG. 4.

Referring to FIGS. 4*a*, 4*b* and 13 in particular, towards the downstream end 110*a* of the air exit 110 a sealing gasket 116 is provided between the inner wall 120 of the air exit 110 and the outer wall 360 of the body 30. This has a number of functions including sealing against fluid flowing along the primary fluid flow path 400 and then between the inner wall 120 and the outer wall 360 to the second end 34 of the body 30 and bypassing the primary fluid outlet 440. A second function of the gasket 116 is to retain the position of the inner wall 120 with respect to the outer wall 360 and hence retains the air exit 110 in position with respect to the outer wall 360.

Figure 5:
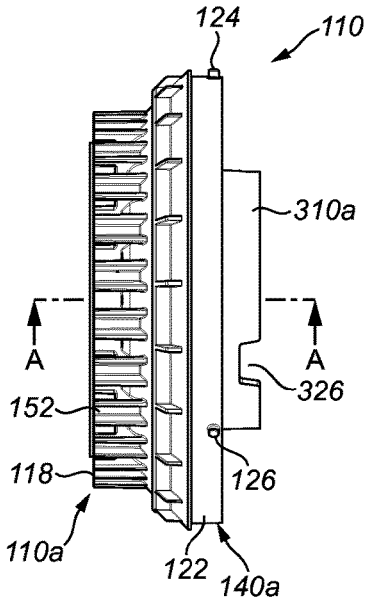
FIG. 5 shows an air exit according to the invention.
Figure 6:
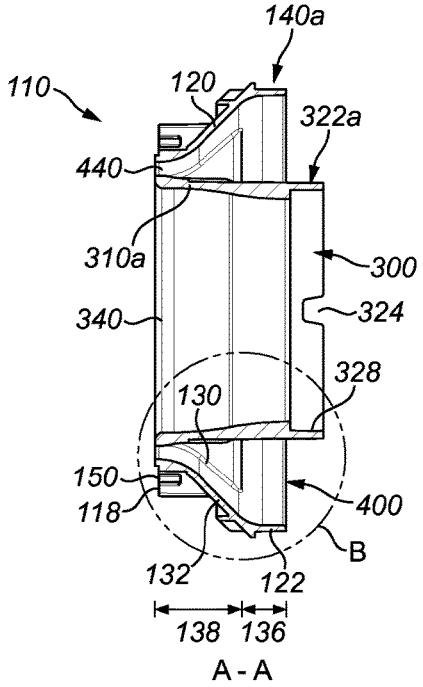
FIG. 6 shows a cross section through the air exit of FIG. 5.
Figure 7:
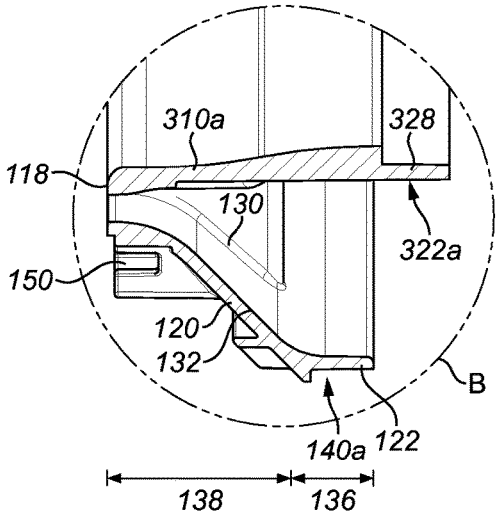
FIG. 7 shows region B of FIG. 6 in more detail.
Figure 8:
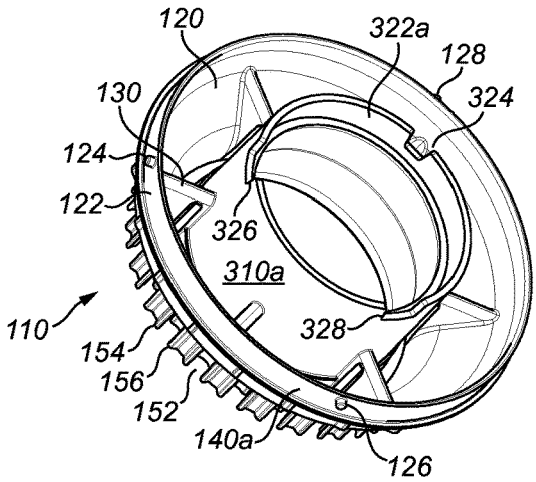
FIG. 8 shows a rear perspective view of the air exit of FIG. 5.
Figure 9:
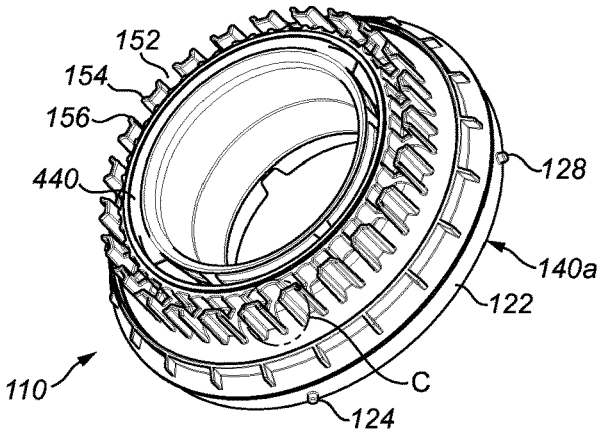
FIG. 9 shows a front perspective view of the air exit of FIG. 5.
Figure 10:
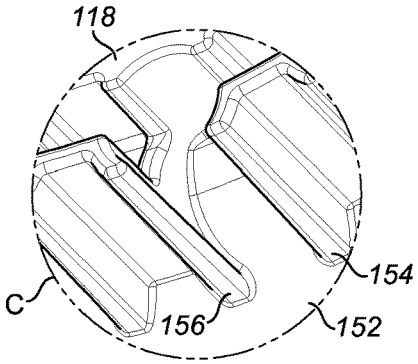
FIG. 10 shows region C of FIG. 9 in more detail.
Figure 11:
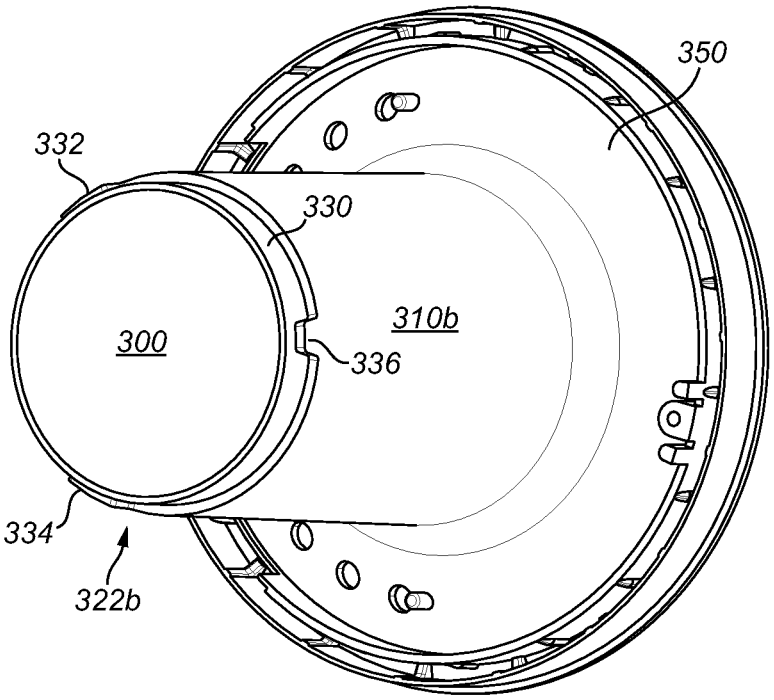
FIG. 11 shows a front perspective view of a duct.
Figure 12:
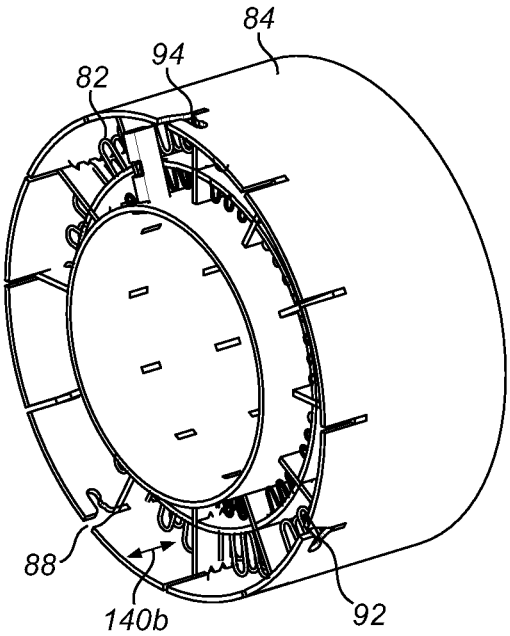
FIG. 12 shows a front perspective view of a heater.

Referring to FIGS. 5 to 7 in particular, the inner wall 120 has two sections; a first section 136 includes the first part 140*a* of the second connection 140 and is generally parallel to one or more of the outer wall 360, the first duct 310*a* and the heater 80. A second section 138 includes the flow directing portion 132. This second section 138 has a curved profile and in the flow direction through the primary fluid flow path 400 the second section curves towards the centre line A-A of the duct and the fluid outlet 320. The flow directing portion 132 is curved and has a smooth surface which is in contact with fluid flowing through the primary fluid flow path 400.

Figure 14A:
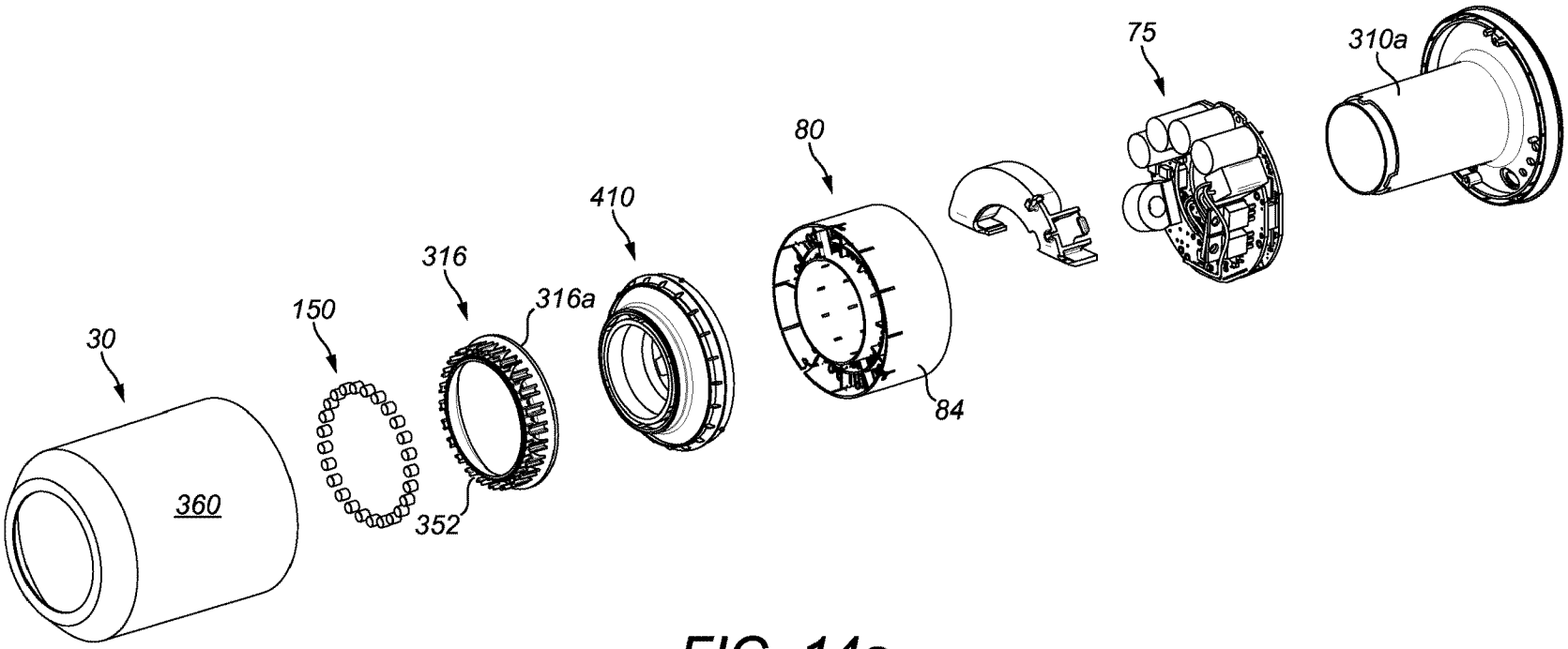
FIG. 14*a* shows an exploded side view of components of a body of a further appliance.
Figure 14B:
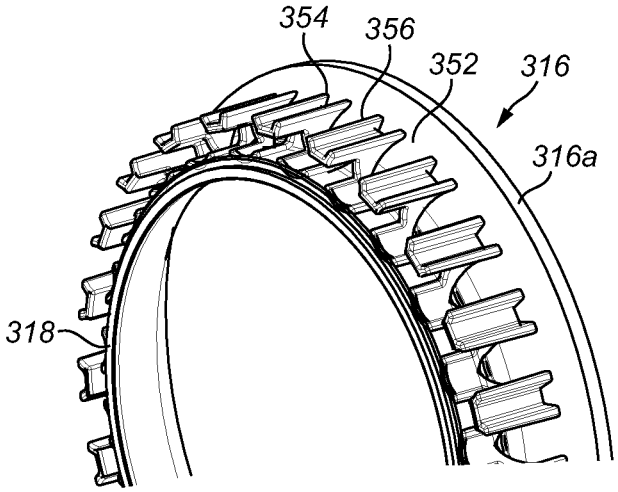
FIG. 14*b* shows part of the gasket of FIG. 14*a* in more detail.

Constraining the relative radial locations of the inner components of the body 36 of the hairdryer is useful as it allows each component to be concentric within the body 36. Referring to FIGS. 13 and 14 in particular, the body 36 extends lengthwise from a first end 32 to a second end 34 and within the body a number of different components are housed each of which extend along the length of the body. Firstly, there is the inner duct 310; this is surrounded by the heater 80 for at least a part of the length of the inner duct 310 and the heater 80 is surrounded by the outer wall 360 of the body 36. It is important that the heater 80 does not touch either of the inner duct 310 or the outer wall 360 as this will create a hot spot where heat from the heater 80 can transfer directly to an external surface of the appliance, it could also reduce the life of the heater 80. There is very little space between each of the components within the body 36, so a loss of concentricity could cause the heater to touch the inner duct 310 or the outer body 360.

The primary fluid flow path 400 that extends along the body 36 is annular and should have generally consistent inner and outer diameter along the length of the body 36 otherwise there will be uneven flow around the primary fluid flow path 400 and this would result in the heater 80 having thermal fluctuations radially around the heater 80. The outer wall 360 and the duct 310 are generally parallel along the length of the body. If the heater 80 did contact one of the inner duct 310 and outer body 360 that define the space in which the heater 80 resides there would be a thermal fluctuation along the length of the heater 80. Both of these outcomes would compromise the efficiency of the appliance and possible cause damage to some of the components.

The inner duct 310 is connected to the body 36 at the first end 32 of the body 36 via a side wall and by fixing the inner duct 310 to the air exit 110 and the heater 80 near the second end 34 of the body 36, the spacing and concentricity of these components is ensured along with the cross sectional profile of the primary fluid flow path 400.

Referring to FIGS. 4*a* and 4*b*, a first gap 112 is provided between the heater 80 and the outer wall 360 and a second gap 114 is provided between the heater 80 and the inner duct 310. The first gap 112 and the second gap 114 provide cool walls between the heater 80 and a respective externally accessible surface. Some fluid flowing through the primary fluid flow path 400 flows along these gaps 112, 114 providing a fluid insulator along the length of the heater 80 to reduce the temperature of the outer wall 360 and the inner duct 310. The fluid that flows through the second gap 114 rejoins the main primary fluid flow path (that flows directly through the heater 80) at the air exit 110. The first gap 112 continues beyond the heater 80 towards the second end 34 of the body 30 and the sealing gasket 116 that seals between the inner wall 120 of the air exit 110 and the outer wall 360 of the body 36 providing a fluid insulator between the inner wall and the outer wall 360.

At the front or second end 34 of the body 30 a plurality of magnets 150 are disposed radially spaced around the primary fluid outlet 440. These magnets 150 comprise one part of a magnetic coupling to an attachment (not shown) such as a concentrator or diffuser which includes corresponding magnets or magnetic material which are attracted to the magnets 150 to connect the attachment to the body 30 of the hairdryer 10. The outer wall 360 of the body 30 has an end wall 362 which extends radially inwards of the outer wall 360 towards the centre line A-A of the body 30. In this example, the magnets 150 are housed within the air exit 110 and abut or are adjacent the end wall 362 of the body 30. The magnets 150 are cylinders which are push or interference fit into receiving units 152 located radially spaced around a front face of the air exit 110. The inner wall 120 thus has a first inner facing surface which is a flow directing surface 132 and a second outer facing surface 134 which includes the receiving units 152 for the magnets 150.

Each receiving unit 152 includes a pair or arms 154, 156 between which a magnet 150 is pushed until the magnet 150 is flush with the front face 118 of the air exit. By having a flush surface, the air exit 110 is able to abut the end wall 362 of the body 30 maximising magnetic attraction produced by the array of magnets 150. In addition, having a flush front face 118 to the air exit 110 helps to position the air exit 110 with respect to the outer wall 360 of the body 30.

The gasket 116 is located somewhere along the inner wall 120 of the air exit 110. The exact positioning is not critical as long as the gasket 116 does not interfere with the lap joint 140 or the function of the magnets 150.

Figure 15:
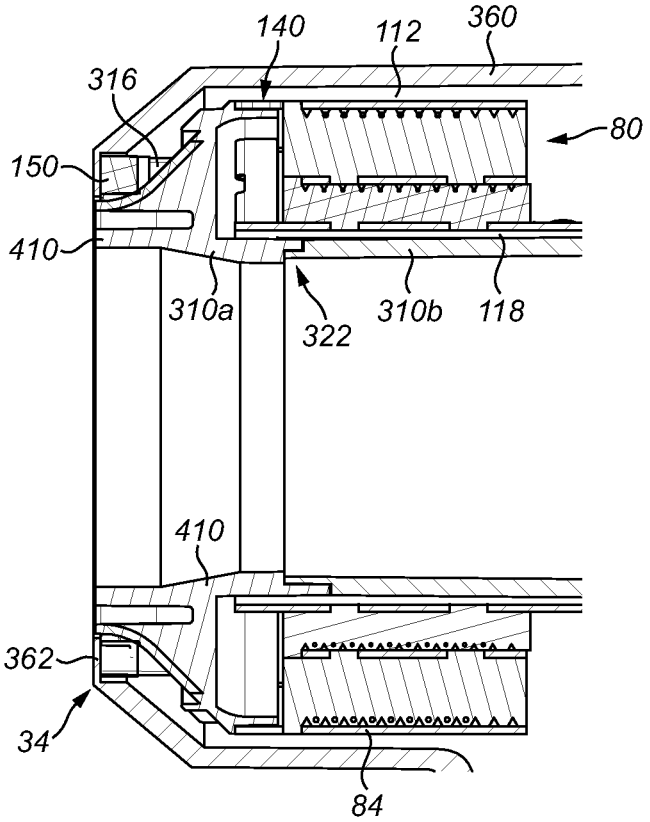
FIG. 15 shows a cross section through the body of the appliance of FIG. 14.
Figure 16:
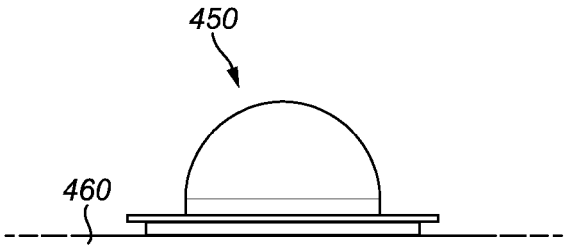
FIG. 16 shows an example of an attachment for a hairdryer.
Figure 17:
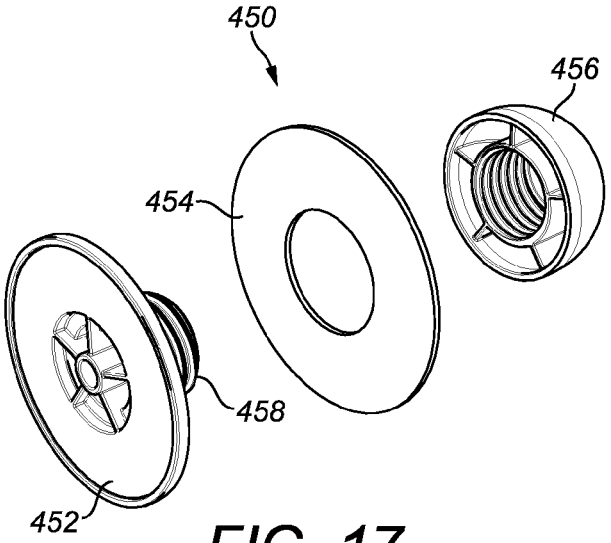
FIG. 17 shows a rear perspective explosion of the attachment shown in FIG. 16.
Figure 18:
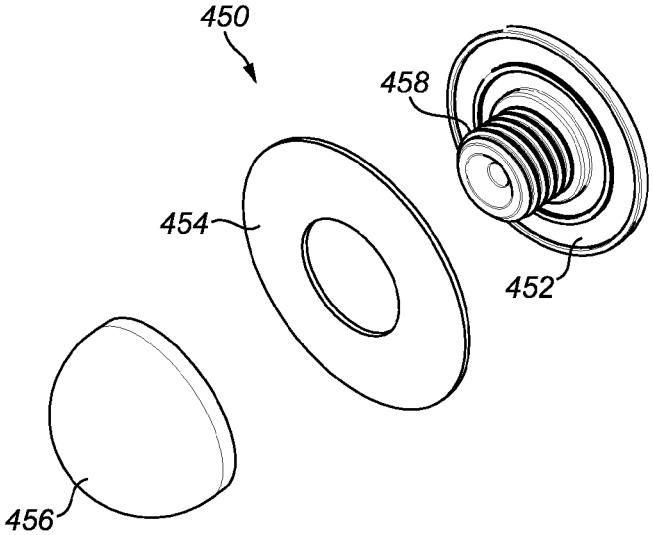
FIG. 18 shows a front perspective explosion of the attachment shown in FIG. 16.
Figure 19:
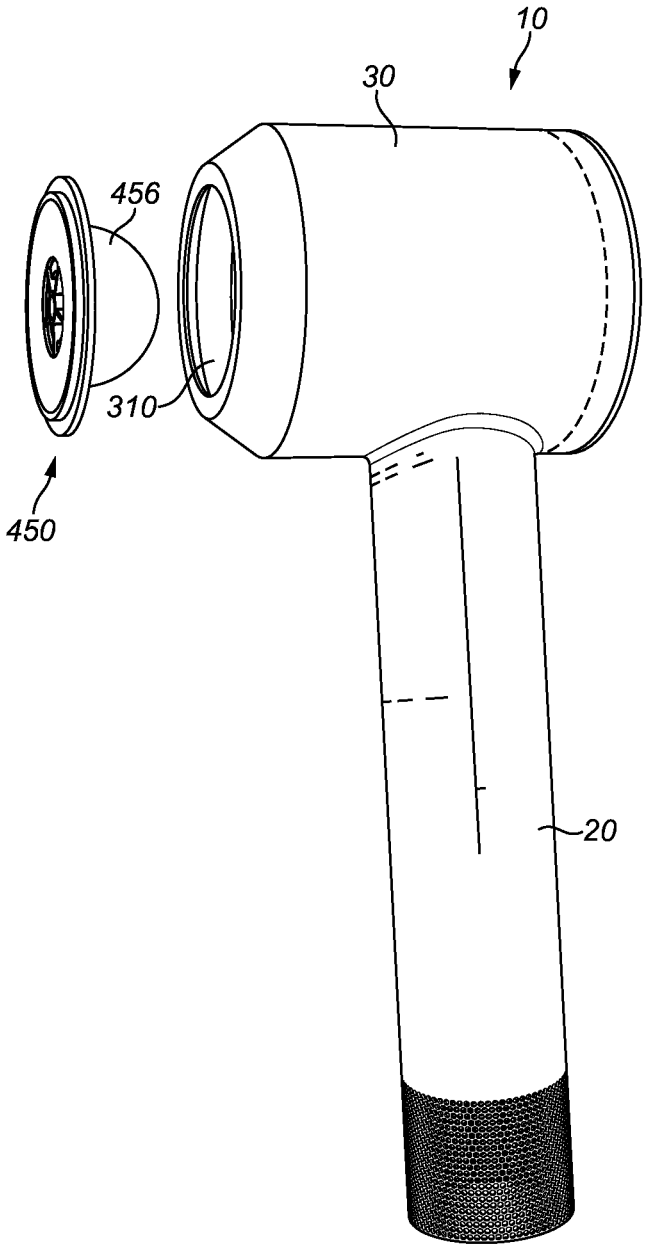
FIG. 19 shows an isometric view of a hairdryer with the attachment of FIG. 16.

An alternative gasket 316 is shown in FIGS. 14 and 15. In this embodiment, the magnets 150 are radially spaced around the fluid outlet 440 as before, however the magnets 150 are housed within the gasket 316 rather than the air exit 410. The gasket 316 comprises a plurality of receiving units 352 each one designed to receive one of the cylindrical magnets 150. Each receiving unit 352 comprises a pair of arms 354, 356 between which a magnet 150 is pushed until the magnet 150 is flush with the front face 318 of the gasket 318. Having a flush surface means the magnets 150 can abut the end wall 362 of the outer body 360 of the body 30 maximising magnetic attraction between the body and an attachment.

The gaskets 116, 316 both have a sealing surface 116*a*, 316*a* respectively which, when the gasket 116, 316 is positioned with respect to the air exit 110, 410 and the outer wall 360 of the body 30 seals against the outer wall 360 preventing fluid from the primary fluid flow path 400 exiting the appliance anywhere other than the primary fluid outlet 440.

FIGS. 16 to 19 show various views of an attachment to which a hairdryer 10 may be removably attached via the magnets 150. In this example, the attachment is a docking port 450 for the hairdryer 10 when not in use. The docking port 450 is conveniently attached to a surface 460 such as a wall, vanity unit, or wardrobe for example.

The docking unit 450 has three parts, a base 452 for attachment to a surface 460, a ring 454 of magnetic material or magnetised material and a cone 456 for engaging with the duct 310 of a hairdryer 10. The base 452 includes a screw thread 458 onto which the cone 456 is screwed when the ring 454 is in position. The ring 454 of magnetic material or magnetised material can be made from one of iron, a steel, or flakes of magnetic material moulded into a resin such as epoxy, other examples will be apparent to the skilled person.

The inner duct 310 is generally tubular and it is preferred that the wall 312 that defines first duct 310*a* tapers radially outwardly towards the downstream end or the fluid outlet 340 (FIG. 4). Thus, the wall 312 thins towards the outlet 340 increasing the diameter of the fluid flow path 300 slightly at the outlet 340. Fluid that flows through the fluid flow path 300 is thus angled towards the outer wall 360 and the primary fluid outlet 440.

The gasket 116, 316 seal the inner wall 110, 410 respectively against the outer wall 360. The seal need not be a perfect seal as in some circumstances it may be desirable to allow some controlled leakage through the gasket 116, 316 to provide a cooling flow of the outer wall 360 downstream of the gasket 116, 316. The gasket 116, 316 could comprise a number of radially disposed bleeds or recesses to achieve this.

The invention has been described in detail with respect to a hairdryer however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hair care appliance comprising a body having an outer wall, an inner wall that is spaced from at least a portion of the outer wall, a duct extending at least partially along the body within the outer wall, an interior passage extending about the duct for receiving a primary fluid flow, wherein an inner extent of the interior passage is defined by an outer surface of the duct and an outer extent of the interior passage is defined by an inner surface of the inner wall, a primary fluid outlet at an end of the interior passage for emitting the primary fluid flow from the body, wherein the primary fluid outlet is defined by the outer surface of the duct and the inner surface of the inner wall of the body, wherein at least one spacer is provided at the end of the interior passage and the at least one spacer extends from the inner surface of the inner wall to the outer surface of the duct.

2. The appliance of claim 1, wherein the inner wall extends from the outer wall towards the duct.

3. The appliance of claim 1, wherein the inner wall extends radially around the duct.

4. The appliance of claim 2, wherein the inner wall extends from the outer wall towards the primary fluid outlet.

5. The appliance of claim 1, wherein the at least one spacer comprises a plurality of spacers radially spaced from each other.

6. The appliance of claim 1, wherein the at least one spacer is a supporting rib.

7. The appliance of claim 1, wherein the duct is formed from two parts, a first part which is fixed to the inner wall and a second part which connects to the first part.

8. The appliance of claim 1, wherein the inner wall comprises a sealing portion and a flow directing portion.

9. The appliance of claim 8, wherein the sealing portion seals between the outer wall and the inner wall.

10. The appliance of claim 8, wherein the sealing portion is spaced from an end of the inner wall.

11. The appliance of claim 8, wherein a region defined between the inner wall, sealing portion and the outer wall is a cooling path.

12. The appliance of claim 8, wherein the flow directing portion comprises a surface of the inner wall that together with the duct defines a part of the interior passage.

13. The appliance of claim 12, wherein the surface of the inner wall is smooth.

14. The appliance of claim 1, comprising a heater extending about the duct.

15. The appliance of claim 14, wherein the heater is annular.

16. The appliance of claim 14, wherein the heater is housed within a sleeve.

17. The appliance of claim 16, wherein the sleeve extends longitudinally beyond the heater at one end.

18. The appliance of claim 17, wherein the sleeve extension is adapted to cooperate with the inner wall to locate the heater longitudinally within the body.

19. The appliance of claim 17, wherein the sleeve extension is adapted to cooperate with the inner wall to locate the heater radially within the body.

20. The appliance of claim 18, wherein the one of the inner wall and the sleeve extension includes a recess and the other one of the inner wall and sleeve extension includes a projection adapted to cooperate with the recess.

21. The appliance of claim 1, wherein the primary fluid outlet is at a downstream end of the body.

22. The appliance of claim 21, wherein the inner wall has a downstream end and an upstream end and the downstream end at least partially defines the primary fluid outlet.

23. The appliance of claim 22, wherein the upstream end of the inner wall extends towards the outer wall.

24. The appliance of claim 22, wherein the inner wall includes a sealing portion that extends to the outer wall.

25. The appliance of claim 24, wherein the sealing portion is between the upstream end and downstream end of the inner wall.

26. The appliance of claim 1, wherein the appliance is a hairdryer.

27. A hair care appliance comprising a body having an outer wall, an inner wall that is spaced from at least a portion of the outer wall, a duct extending at least partially along the body within the outer wall, an interior passage extending about the duct for receiving a primary fluid flow, wherein an inner extent of the interior passage is defined by an outer surface of the duct and an outer extent of the interior passage is defined by an inner surface of the inner wall, a primary fluid outlet at an end of the interior passage for emitting the primary fluid flow from the body, wherein the primary fluid outlet is defined by the outer surface of the duct and the inner surface of the inner wall of the body, wherein the duct is formed from two parts, a first part which is fixed to the inner surface of the inner wall and a second part which connects to the first part.

28. The appliance of claim 27, wherein the first part of the duct is fixed to the inner wall by at least one supporting rib.

29. The appliance of claim 28, wherein the first part of the duct, the inner wall and the at least one supporting rib are moulded as a single unit.

30. The appliance of claim 27, wherein the first part of the duct connects to the second part of the duct in one orientation.

31. The appliance of claim 30, wherein the connection between the first part of the duct and the second part of the duct includes a lap joint.

32. The appliance of claim 30, wherein one of the first and second parts of the duct includes a recess and the other one of the first and second parts includes a projection adapted to cooperate with the recess to provide a connection between the first part of the duct and the second part of the duct.

33. A hand held appliance comprising a body having an outer wall, an inner wall that is spaced from at least a portion of the outer wall, a duct extending at least partially along the body within the outer wall, an interior passage extending about the duct for receiving a primary fluid flow, wherein an inner extent of the interior passage is defined by an outer surface of the duct and an outer extent of the interior passage is defined by an inner surface of the inner wall, a primary fluid outlet at an end of the interior passage for emitting the primary fluid flow from the body, wherein the primary fluid outlet is defined by the outer surface of the duct and the inner surface of the inner wall of the body, wherein at least one spacer is provided at the end of the interior passage and the at least one spacer extends from the inner surface of the inner wall to the outer surface of the duct.

34. A hand held appliance comprising a body having an outer wall, an inner wall that is spaced from at least a portion of the outer wall, a duct extending at least partially along the body within the outer wall, an interior passage extending about the duct for receiving a primary fluid flow, wherein an inner extent of the interior passage is defined by an outer surface of the duct and an outer extent of the interior passage is defined by an inner surface of the inner wall, a primary fluid outlet at an end of the interior passage for emitting the primary fluid flow from the body, wherein the primary fluid outlet is defined by the outer surface of the duct and the inner surface of the inner wall of the body wherein the duct is formed from two parts, a first part which is fixed to the inner surface of the inner wall and a second part which connects to the first part.

* * * * *